United States Patent [19]

Gerber

[11] Patent Number: 4,471,639

[45] Date of Patent: Sep. 18, 1984

[54] ROLL ORIENTATION CONTROL SYSTEM FOR STRAIGHTENING MACHINES

[75] Inventor: Terry L. Gerber, Lisbon, Ohio

[73] Assignee: E. W. Bliss Company, Inc., Salem, Ohio

[21] Appl. No.: 438,152

[22] Filed: Nov. 1, 1982

[51] Int. Cl.[3] ..... B21B 37/08

[52] U.S. Cl. ..... 72/20; 72/21; 72/99

[58] Field of Search ..... 72/95, 98, 99, 100, 72/245, 20, 21

[56] References Cited

U.S. PATENT DOCUMENTS

| | | | |
|---|---|---|---|
| 1,457,215 | 5/1923 | Dayton . | |
| 3,258,946 | 7/1966 | Hills | 72/20 |
| 3,286,495 | 11/1966 | Diolot | 72/8 |
| 3,398,559 | 8/1968 | Tracy | 72/8 |
| 3,533,257 | 10/1970 | Aldred | 72/99 |
| 3,540,251 | 11/1970 | Page | 72/99 |
| 3,566,638 | 3/1971 | Herbst | 72/8 |
| 3,604,236 | 9/1971 | Hyams | 72/99 |
| 3,626,732 | 12/1971 | Krafft et al. | 72/99 |
| 3,706,215 | 12/1972 | Horton | 72/99 |
| 3,736,782 | 6/1973 | Nobuhiro et al. | 72/8 |
| 3,858,425 | 1/1975 | Thompson | 72/245 |
| 3,961,510 | 6/1976 | Kovacs | 72/20 |
| 4,152,913 | 5/1979 | Zerhoch et al. | 72/20 |

FOREIGN PATENT DOCUMENTS

| | | |
|---|---|---|
| 1900016 | 8/1970 | Fed. Rep. of Germany . |
| 2349693 | 4/1975 | Fed. Rep. of Germany . |
| 298396 | 6/1971 | U.S.S.R. . |

*Primary Examiner*—Lowell A. Larson

*Attorney, Agent, or Firm*—Body, Vickers & Daniels

[57] ABSTRACT

Angular orientation of a straightener machine roll relative to the vertical axis thereof is achieved through the use of a pair of single acting hydraulic actuators imposing force against a roll support member on laterally opposite sides of a vertical plane through the roll axis, and vertical orientation is achieved through the use of a double acting hydraulic piston and cylinder unit to which the roll support member is attached. Corresponding servo valve mechanisms control fluid flow to the two single acting actuators and to the double acting piston and cylinder units, and both angular orientation and vertical orientation are selectively position or force controlled.

10 Claims, 7 Drawing Figures

ROLL ORIENTATION CONTROL SYSTEM FOR STRAIGHTENING MACHINES

BACKGROUND OF THE INVENTION

The present invention relates to the art of straightener machines and, more particularly, to improved arrangements for controlling the angular, or angular and vertical orientation of a straightener roll in such machines.

Straightener machines for working rod, tube or other elongate stock are of course well known. Such machines have a plurality of pairs of straightener rolls, each pair including an upper and a lower roll and which pairs are aligned along the machine axis or pass line with the horizontal roll axes of the upper rolls orientated at one angle and the axes of the lower rolls oriented at a different angle. The rolls are of concave contour and the latter together with the different angular orientation between the upper and lower rolls provides a path therebetween and along which stock to be worked is moved in response to driving of the upper and lower rolls.

It is likewise well known in such straightener machines to provide for the rolls to be individually adjustable angularly relative to a vertical roll support axis, and to provide for at least certain of the rolls to be vertically adjustable along the roll support axis. For example, in a six roll mill comprising three pairs of upper and lower rolls, the lower rolls of the outer pairs are angularly adjustable and vertically fixed, and the upper three rolls and the lower intermediate roll are each both angularly and vertically adJustable. It will be appreciated of course that both obtaining and maintaining optimum orientation of the straightener rolls is necessary to achieve desired diametral dimensions, straightness, roundness and other properties with respect to a workpiece being processed.

Heretofore, arrangements for achieving angular orientation of a straightener roll have included the use of a pair of manually rotated screws arranged to push against a support member for the roll on laterally opposite sides of the vertical axis. Other arrangements have included the use of a motor driven bellcrank mechanism and a pneumatically or hydraulically actuated device to lock the roll in an adjusted position. Such prior arrangements are disadvantageous for a number of reasons including the fact that the machine operator cannot conveniently or quickly make angular adjustments. In this respect, the operator must first release one or both of the manually rotated screws, or the pneumatically or hydraulically actuated lock mechanism, in order to free the roll for angular displacement. The operator must then make the desired adjustment through appropriate manipulation of the screws or the bellcrank mechanism and then relock the roll in the new position. Another disadvantage resides in the fact that the operator cannot conveniently or safely make angular roll adjustments while a workpiece is being processed. In this respect, it will be appreciated that releasing of the screws or the locking device during machine operation is hazardous and, more importantly, is undesirable if not intolorable from the standpoint of the effects thereof on the desired processing characteristics with respect to the workpiece. Any attempt to make an angular roll adjustment during machine operation requires considerable care and skill on the part of the operator, as does the initial set-up of angular orientation for the straightener rolls, whereby such set-up and adjustments of angular orientation are time consuming and tedious processes. This, together with the fact that the accuracy of initial set-up and subsequent angular adjustment of the rolls is dependent in a large part on the skill of the operator, can and does affect both the rate of production for a given machine and the quality of the work product.

Vertical roll orientation has been achieved heretofore generally through the use of manually or motor driven screw arrangements and locking devices for maintaining the roll in an adjusted position. Such adjusting screw arrangements do not enable an operator to conveniently or quickly make vertical adjustments during initial set-up, or to make vertical adjustments while a workpiece is being processed through the machine. In this respect, such vertical adjustment requires that the operator first release the angular adjusting screws or locking device, then release the vertical adjusting screw lock and make the vertical adjustment, then relock the vertical adjusting screw, and then reset the angular adjustment components. In addition to such a procedure being time consuming and tedious, it will be appreciated that release of the angular components promotes the probability of changing the previously established angular setting of the roll. Accordingly, the problems referred to hereinabove in connection with angular adjustment are compounded by the required vertical adjustment feature. An additional shortcoming of vertical adjusting screw arrangements is the existence of backlash in the mechanical components which adversely affects both obtaining and maintaining accuracy of a vertical setting.

It has also been proposed, as shown in U.S. Pat. No. 3,626,732 to Krafft et al and German patent application No. 2,349,693, to provide the lower roll of a machine for straightening workpieces of non-circular cross-section with a hydraulic biasing arrangement for vertically positioning a lower roll in a manner which enables the lower roll to vertically reciprocate during operation of the machine and in response to variations in workpiece contour which effect pressure conditions in the hydraulic system. Thus, the biasing arrangement is not capable of maintaining a relatively fixed vertical roll position as is required in connection with the straightening of circular workpieces, and for which use the lower roll in the machines in the Krafft et al and German patent application are adapted to rigidly engage against the machine frame. Moreover, both the upper and lower rolls in the latter patents are angularly adjustable through the use of screw arrangements and the upper roll is vertically adjustable through a screw arrangement whereby, in any event, vertical or angular adjustment of the upper roll and angular adjustment of the lower roll requires shut-down of the machine and presents the problems referred to hereinabove in connection with such screw type adjusting arrangements.

SUMMARY OF THE INVENTION

In accordance with the present invention an improved arrangement for achieving and controlling roll orientation in a straightener machine is provided and by which the foregoing and other problems and disadvantages of arrangements heretofore available are overcome. More particularly in this respect, the improved arrangement according to the present invention enables adjusting angular orientation of a roll or adjusting both angular and vertical orientation thereof and, in either event, enables such adjustments to be quickly and accurately achieved during set-up and to be made quickly and accurately while the machine is in operation. Moreover, in connection with angular and vertical adjustments, either adjustment can be made independent of and without affecting the setting of the other. Further, such angular or angular and vertical adjustments are maintained without the use of locking devices, avoiding the time required to release such devices and the potential changing of a pre-established adjustment as a result thereof.

With regard to a given straightener roll in a machine, the roll is supported for pivotal movement in opposite directions about a vertical axis, such as by means of a roll support member on which the roll is mounted. The foregoing angular orientation and adjustment capabilities are achieved in accordance with the present invention by a servo valve controlled linearly displaceable hydraulic drive unit which is operable in response to fluid flow relative thereto to pivot the roll support member and thus the roll in opposite directions relative to the vertical axis and to maintain the roll in a desired angular orientation. No locking devices are employed, whereby the drive unit can be actuated at any time during operation of the machine to quickly achieve a change in angular orientation. With respect to a roll which is both angularly and vertically adjustable, the roll support member further supports the roll for reciprocation in opposite directions along the vertical axis and, in accordance with the present invention, a servo valve controlled double acting hydraulic drive unit is associated with the roll support member so as to achieve vertical displacement thereof in response to fluid flow relative to the drive unit, and to maintain the roll in a desired vertical orientation. Again, no locking devices are provided, whereby vertical adjustments can be made at any time during operation of the machine. Furthermore, as will become apparent hereinafter, component parts by which angular and vertical adjustments are achieved have relative displacement capabilities which provide for angular and vertical adjustments to be made independently of one another and for either to be made without affecting the setting of the other.

In accordance with another aspect of the invention, the hydraulic drive units by which angular and vertical orientations are achieved are adapted to be selectively controlled either in accordance with the actual position of a roll relative to the machine, or in accordance with the actual contact force between the roll and a workpiece. Such selectivity advantageously enables operation of the straightener machine with a desired angular and/or vertical roll position in connection with the processing of workpieces wherein roll positioning is desired independent of consideration of roll-workpiece contact force variations, or operation of the straightener machine in connection with the processing of workpieces wherein physical conditions of the workpieces, such as initial crookedness for example, render the angular and/or vertical roll-workpiece contact forces a more desirable criteria for roll orientation control.

In connection with either angular or angular and vertical orientation, and in connection with either position or force control of the hydraulic drive units, the latter are each in a closed loop servo valve controlled electrohydraulic circuit in which the corresponding servo valve is responsive to a command signal representing a differential either between a desired position reference signal and an actual roll position signal, or between a desired force reference signal and a signal representative of actual roll-workpiece contact force. Accordingly, it will be appreciated that once a predetermined reference signal is established the corresponding one of the drive units is controlled by the corresponding servo valve to automatically maintain the roll in an orientation corresponding to the reference signal. Obtaining a desired reference signal with respect to a test or set-up workpiece is quickly achieved, whereby initial set-up time is considerably reduced. Moreover, subsequent set-up time for similar workpieces is advantageously minimized where a desired reference signal has been previously established. Still further, it is not necessary to shut down the machine to make adjustments during operation thereof in that adjustments can be made simply and automatically by adjusting the reference signal. These capabilities individually and collectively improve machine productivity, product quality and operator safety, the latter especially during adjustment procedures while the machine is running. Furthermore, these capabilities eliminate the high degree of skill heretofore required in connection with set-up and mechanical adjustments of roll orientation.

It is accordingly an outstanding object of the present invention to provide improved arrangements for obtaining and controlling angular or angular and vertical orientation of a straightener machine roll and by which a desired orientation or adjustment of orientation is quickly and more accurately achieved and maintained than heretofore possible.

Another object is the provision of improved arrangements of the foregoing character which enable adjustments of the angular or angular and vertical orientation of a given roll to be made during operation of the machine, and for either angular or vertical adjusrment to be achieved without affecting an existing setting with respect to the other.

A further object is the provision of arrangements of the foregoing character enabling the maintaining of desired angular or angular and vertical roll orientation with respect, selectively, to the actual position of a roll relative to the machine or the actual roll-workpiece contact force.

Yet another object is the provision of arrangements of the foregoing character wherein angular and vertical orientations are achieved through corresponding linearly displaceable hydraulically actuated drive units each in a corresponding closed loop servo valve controlled hydraulic circuit, and wherein the corresponding roll orientation is maintained and/or changed through actuation of the corresponding servo valve by a command signal representing a differential between actual and desired orientation.

Still another object is the provision of arrangements for obtaining and maintaining orientation of a straightener machine roll in a manner which improves productivity and quality of machine performance, product quality, and operator safety during adjustment procedures, while minimizing set-up and adjustment time and eliminating the high degree of operator skill heretofore required in connection therewith.

BRIEF DESCRIPTION OF THE DRAWINGS

The foregoing objects, and others, will in part be obvious and in part pointed out more fully hereinafter in connection with the written description of preferred embodiments illustrated in the accompanying drawings and in which.

DESCRIPTION OF PREFERRED EMBODIMENTS

Figure 1:
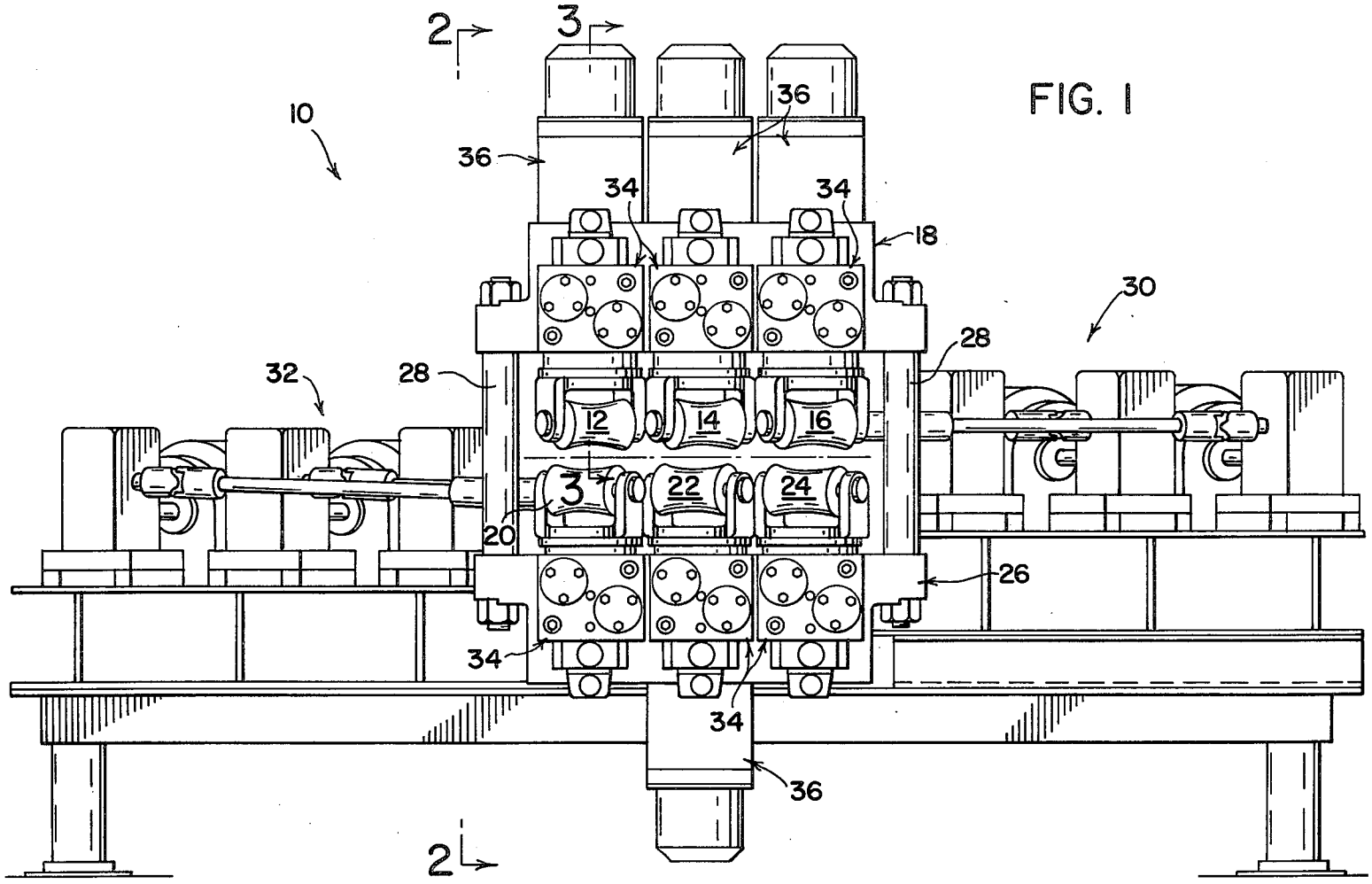
FIG. 1 is a side elevation view illustrating a six roll straightener machine in which the rolls are provided with roll orientating arrangements according to the present invention.

Referring now in greater detail to the drawings wherein the showings are for the purpose of illustrating preferred embodiments of the invention only, and not for the purpose of limiting the invention, FIG. 1 illustrates a six roll straightener machine designated generally by the numeral 10 and which includes upper rolls 12, 14 and 16 supported by an upper roll housing 18, and corresponding lower rolls 20, 22 and 24 supported by a lower roll housing 26. The upper and lower roll housings are spaced apart and interconnected by a plurality of tie rods 28 and, as is well known in the art, one end of each of the straightener rolls is adapted to be driven for rotation of the rolls to advance a workpiece through the machine. The manner in which the rolls are driven is not of importance in connection with the present invention and, in the embodiment shown and as will be appreciated from FIG. 1, upper rolls 12, 14 and 16 are individually driven by corresponding drive units designated generally by the numeral 30 and lower rolls 20, 22 and 24 are similarly driven by individual drive units designated generally by the numeral 32.

In a six roll straightener machine of the character illustrated in FIG. 1, lower rolls 20 and 24 are vertically fixed and angularly adjustable, and upper rolls 12, 14 and 16 and lower roll 22 are both angularly and vertically adjustable, such adjustment characteristics being for purposes well known in connection with the processing of workpieces through straightener machines. The supporting and adjusting arrangements for upper rolls 12, 14 and 16 and lower roll 22 are structurally the same, whereby it will be appreciated that the detailed description hereinafter with regard to the support and adjustment of roll 12 is applicable to that for rolls 14, 16 and 22. Further, as will become apparent hereinafter, angular adjustment of lower rolls 20 and 24 is achieved in the same manner as is angular adjustment of rolls 12, 14, 16 and 22, and the support for lower rolls 20 and 24 can either be the same as that for the other rolls or can be provided by a minor modification thereof.

Figure 2:
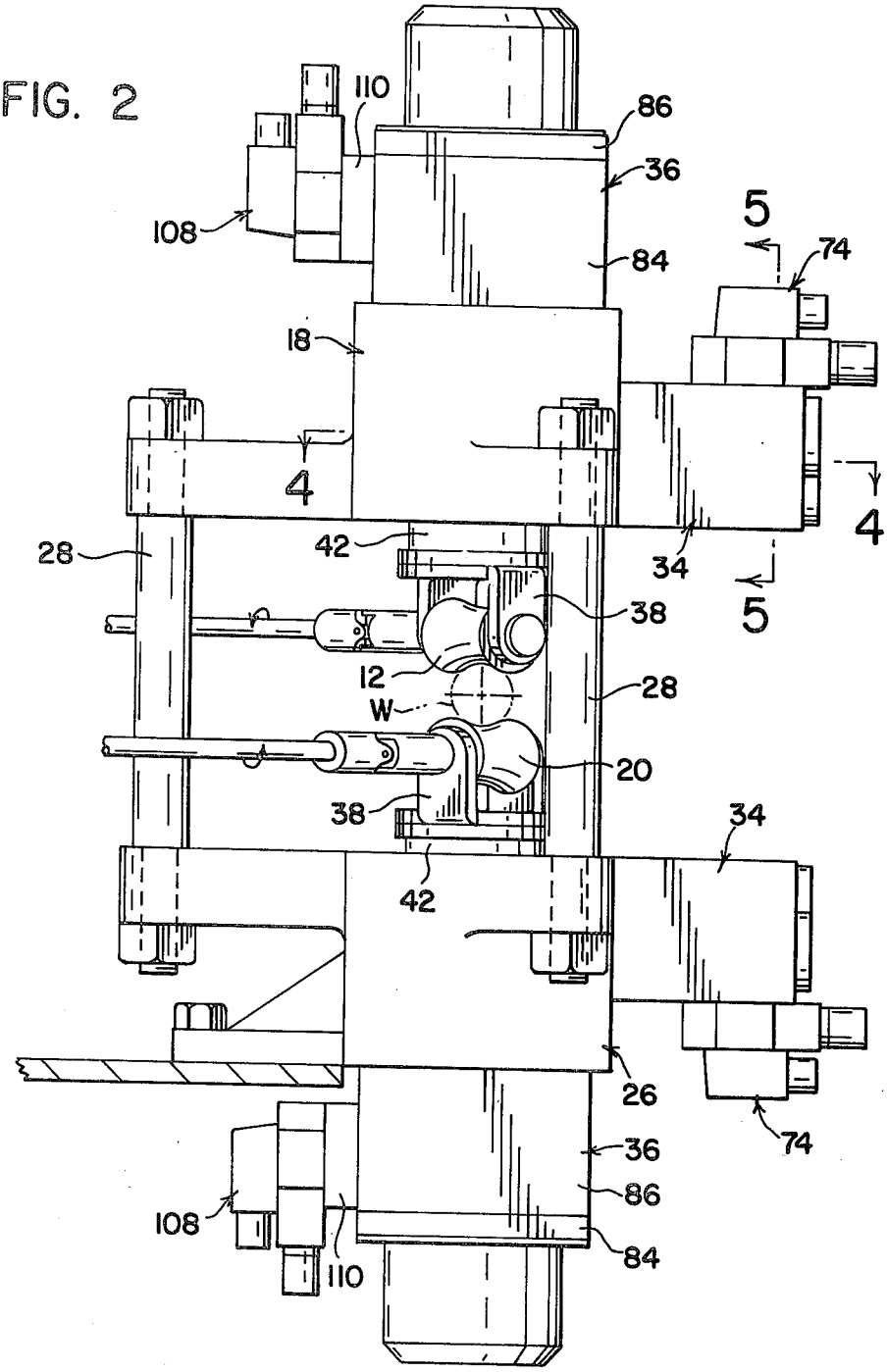
FIG. 2 is an end elevation view of the roll support portion of the machine as seen along line 2—2 in FIG. 1.
Figure 3:
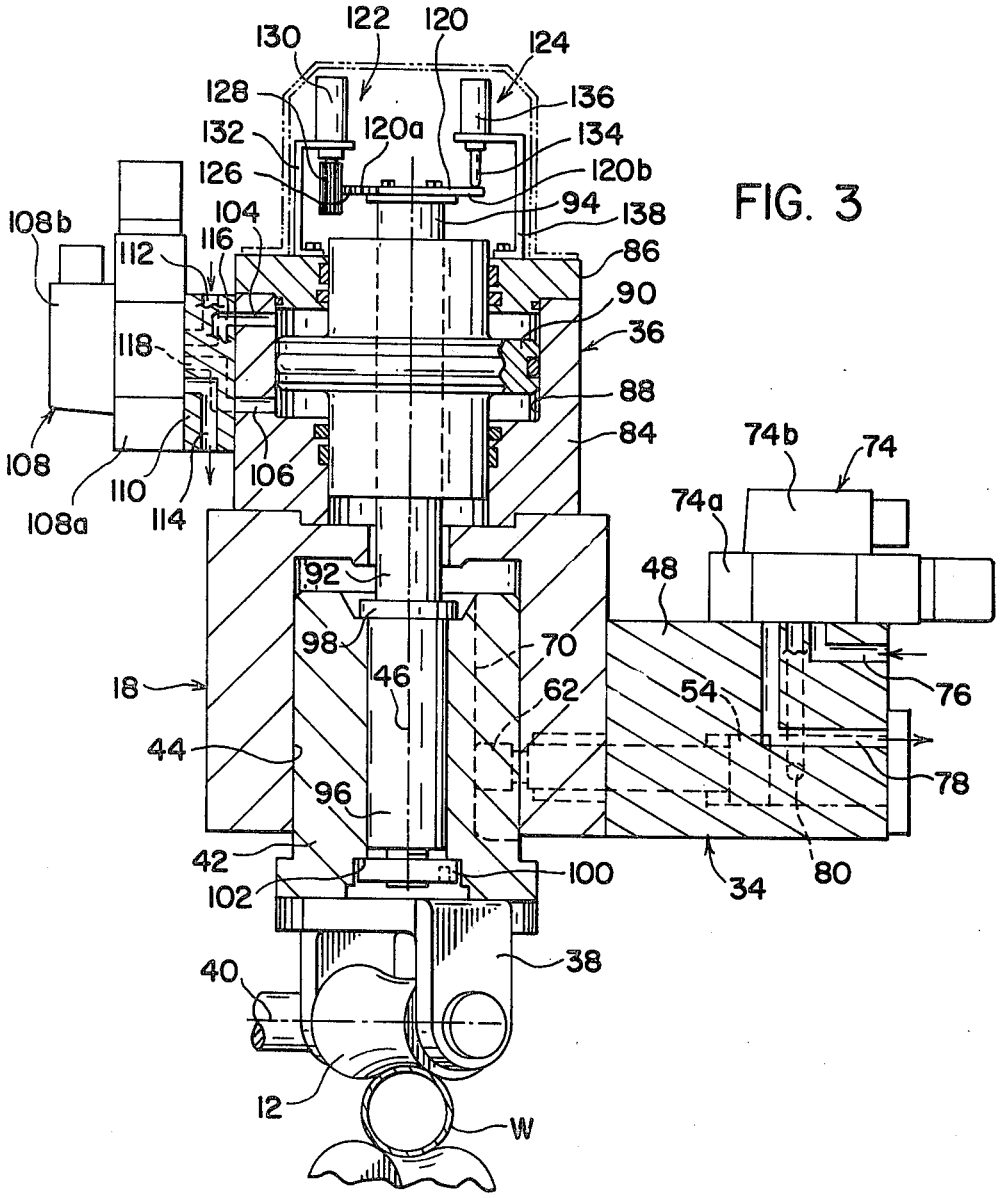
FIG. 3 is a sectional elevation view taken along line 3—3 in FIG. 1 and showing the component parts by which a roll is supported for both angular and vertical displacement relative to the machine.
Figure 4:
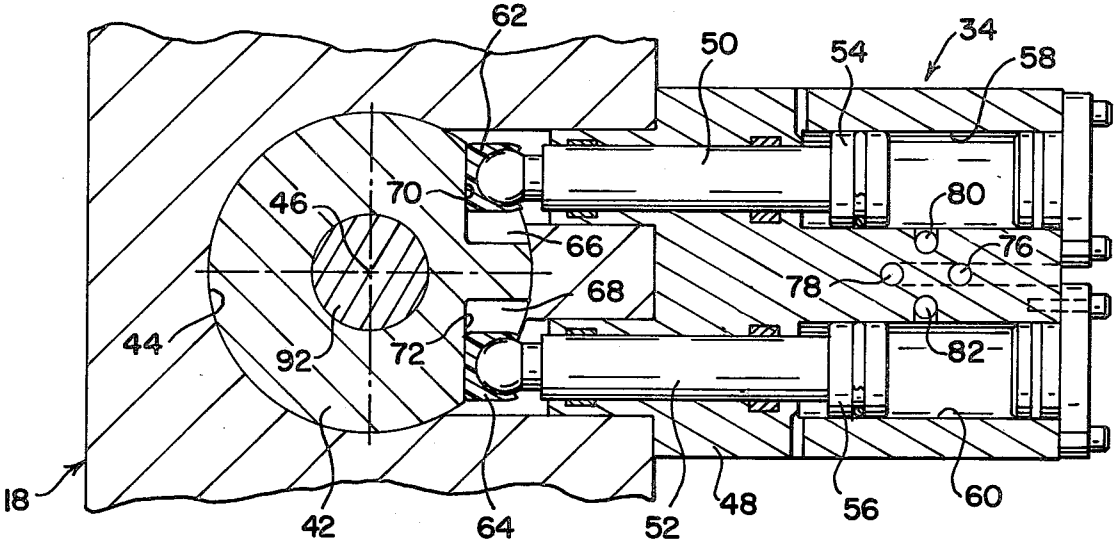
FIG. 4 is a cross-sectional view taken along line 4—4 in FIG. 2 and showing the angular orientation drive unit.
Figure 5:
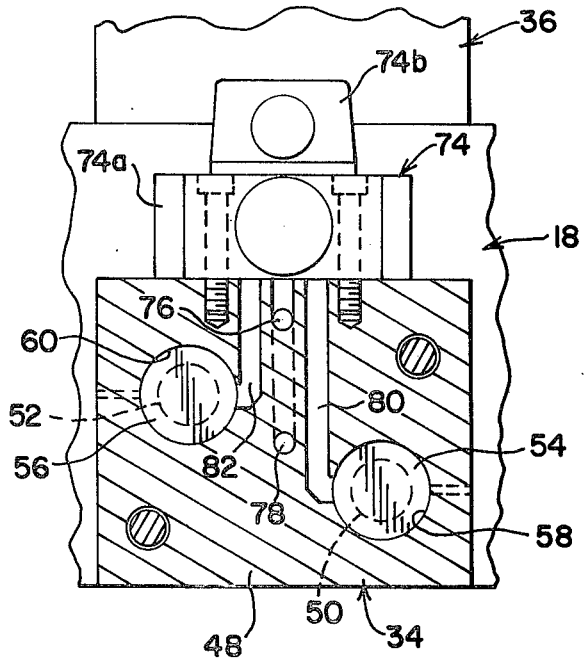
FIG. 5 is a cross-sectional elevation view of the angular orientation drive unit taken along line 5—5 in FIG. 2.

As is shown generally in FIGS. 1 and 2 and in detail in FIGS. 3-5 with respect to upper roll 12, each of the upper and lower roll housings 18 and 26 support a hydraulically actuated angular orientation drive unit 34 for each of the upper and lower rolls, and the upper and lower roll housings further support a hydraulically actuated vertical orientation drive unit 36 for each of the upper rolls 12, 14 and 16 and for lower roll 22. With reference now in particular to FIGS. 3-5, straightener roll 12 is mounted in a standard manner on a yoke member 38 for rotation about a horizontal roll axis 40, and yoke member 38 is bolted or otherwise secured to a cylindrical roll support member 42 received in a cylindrical bore 44 in roll housing 18. Roll support member 42 is both reciprocably and pivotally supported in bore 44 and, accordingly, supports roll 12 for vertical displacement relative to the machine and a workpiece W and for angular displacement relative thereto and in opposite directions around a vertical roll axis 46. Hydraulically actuated angular orientation drive unit 34 provides a pair of single acting piston and cylinder units supported in a common housing 48 bolted or otherwise suitably mounted on the side of roll housing 18. The piston and cylinder units are defined by a pair of horizontally reciprocable piston rods 50 and 52 having inner ends provided with pistons 54 and 56, respectively, and which pistons are received in corresponding cylinder chambers 58 and 60 in housing 48. The outer ends of piston rods 50 and 52 are disposed on laterally opposite sides of roll axis 46, and the outer ends of the piston rods are provided with low friction pads 62 and 64, respectively, each of which is pivotally mounted on the end of the corresponding piston rod by means of a ball and socket type connection. The laterally opposite sides of roll support member 42 are provided with vertically extending recesses 66 and 68 respectively providing laterally and vertically extending planar bearing surfaces 70 and 72 facially and slidably interengaged by the planar outer end of the corresponding one of the friction pads 62 and 64.

It will be appreciated that planar surfaces 70 and 72 and the planar outer ends of the friction pads facilitate sliding displacement of roll support member 42 relative to the friction pads and thus piston rods 50 and 52. In the manner which will become apparent hereinafter, piston rod 50 is adapted to be displaced toward roll support member 42 to achieve pivotal movement of the support member and thus roll 12 counterclockwise about axis 46 with respect to the orientation shown in FIG. 4, and piston rod 52 is adapted to be displaced toward the roll support member to achieve such pivotal movement clockwise relative to axis 46. It will be appreciated that during such pivotal displacements the ball and socket connections between the piston rods and friction pads facilitate maintaining the sliding facial engagement between the outer ends of the pads and surfaces 70 and 72.

Displacement of pistons 54 and 56 and thus piston rods 50 and 52 to achieve pivotal movement of roll support member 42 is controlled by a servo valve unit 74 mounted on housing 48. Servo valve unit 74 includes a valve portion 74*a* supporting a reciprocable spool valve element, not shown, and a control portion 74*b* for controlling displacement of the valve element in response to a command signal, as will become more apparent hereinafter. The valve element is operable in one position to provide for the flow of hydraulic fluid under pressure into chamber 58 and the flow of hydraulic fluid from chamber 60, and is operable in a second portion to reverse such fluid flow relative to chambers 58 and 60. The valve element also has an intermediate or null position in which fluid flow through the valve is blocked. Control of valve 74 in this manner will be described in greater detail hereinafter, and the structure of servo valves by which such flow control is achieved is well known in the art and accordingly need not be described in detail. Briefly, in connection therewith, it will be appreciated from FIGS. 3–5 that drive unit housing 48 is provided with fluid flow inlet and outlet passageways 76 and 78, respectively, having outer ends connectable to a source of hydraulic fluid under pressure and having inner ends opening into valve portion 74*a*. Housing 48 further includes a flow passageway 80 between valve portion 74*a* and chamber 58 and a passageway 82 between valve portion 74*a* and chamber 60. From the foregoing description, it will be appreciated that when the valve element in portion 74*a* is in a first position hydraulic fluid under pressure flowing through inlet passageway 76 is directed into chamber 58 thereby displacing piston 54 and piston rod 50 to the left to pivot roll support member 42 counterclockwise in FIG. 4. At the same time, the valve element opens chamber 60 for communication with outlet passageway 78, whereby hydraulic fluid in chamber 60 is displaced therefrom in response to displacement of piston 56 to the right by support member 42. When the valve element is in a second position, the fluid flow relationship between the inlet and outlet passageways and chambers 58 and 60 is reversed, whereby roll support member 42 is pivoted clockwise in FIG. 4. In the null position of the valve element, fluid flow through the valve to and from chambers 58 and 60 is blocked, whereby the pistons are effectively held in place in the corresponding chamber by the hydraulic fluid therein. Accordingly, roll support member 42 and thus roll 12 are held in a position corresponding to that of the pistons when the valve element is in the null position. A general characteristic of servo valves is the fact that there is a small amount of leakage through the valve when it is in the null position. Therefore, it will be appreciated that some hydraulic pressure is maintained in chambers 58 and 60 when the servo valve is in the null position.

With regard to the straightener rolls which are to be both angularly and vertically adjustable, the vertical adjustment capability is achieved as described in detail hereinafter with regard to roll 12 and as shown in FIGS. 3–5 of the drawing. With reference to the latter Figures, vertical orientation drive unit 36 includes housing members 84 and 86 which are bolted or otherwise suitably interconnected with one another to provide a housing assembly which is in turn bolted or otherwise mounted on roll support housing 18. This housing assembly provides a cylindrical piston chamber 88 above and coaxial with chamber 44 in roll housing 18. Chamber 88 receives and reciprocably supports a piston member 90 having lower and upper ends, not designated numerically, extending through corresponding openings in housing members 84 and 86 which accordingly provide support and guidance for the piston. Piston member 90 is integral with or suitably mounted on a piston rod member 92 having an upper end 94 extending above housing member 86 and having a lower end 96 on which roll support member 42 is suitably mounted. For example, such mounting can be achieved by means of a collar 98 on the piston rod engaging the upper end of the roll support member, and a nut 100 threadedly engaged with the piston rod and abutting against a shoulder 102 at the lower end of the roll support member. Such mounting of roll support member 42 on the piston rod provides for the roll support member to be vertically displaceable therewith and for the piston rod to be pivotally displaceable with roll support member 42 about vertical axis 46.

Housing member 84 of drive unit 36 is provided with fluid passageways 104 and 106 extending radially into chamber 88 at locations adjacent the upper and lower ends of the chamber and thus on opposite sides of piston member 90. A servo valve unit 108 is mounted on housing member 84 by means of a mounting block 110 and includes a reciprocable valve element portion 108*a* and a valve element actuator portion 108*b*. Mounting block 110 is provided with hydraulic fluid flow inlet and outlet passages 112 and 114, respectively, which are connectable to a source of hydraulic fluid under pressure, and with flow passageways 116 and 118 respectively between the valve element portion and passageways 104 and 106 in housing member 84. In a manner similar to servo valve unit 74, and as will become more apparent hereinafter, servo valve unit 108 is responsive to command signals to control the flow of hydraulic fluid under pressure to and from chamber 88. More particularly in this respect, the valve element in valve portion 108*a* has a first position providing for the flow of hydraulic fluid under pressure into chamber 88 through passageway 104 and out of chamber 88 through passageway 106, thus providing for displacement of piston member 90 and thus roll support member 42 and roll 12 downwardly. In a second position of the valve element the foregoing fluid flow relationship is reversed, whereby fluid under pressure enters chamber 88 through passageway 106 and flows from chamber 88 through passageway 104, thus to displace piston 90 and thus roll support member 42 and roll 12 upwardly. The valve element further has a null position in which fluid flow to and from chamber 88 is blocked, whereby the piston and thus roll 12 is effectively held against vertical displacement and in which null position leakage of hydraulic fluid through the servo valve provides a small hydraulic fluid pressure on opposite sides of piston 90.

For the purpose described hereinafter, upper end 94 of piston rod 92 is provided with a plate member 120 which is bolted or otherwise secured thereto for vertical and pivotal displacement therewith. Plate member 120 has laterally or diametrically opposite ends 120*a* and 120*b* cooperatively associated with an angular position transducer assembly 122 and a vertical position transducer assembly 124, respectively. Plate 120 may be of circular or other peripheral contour but in any event is of sufficient width perpendicular to the plane of FIG. 3 to provide for ends 120*a* and 120*b* to maintain cooperative interengagement with the actuating component of the corresponding transducer assembly throughout the extent of pivotal displacement of roll 12 and thus piston rod 92 in opposite directions about vertical axis 46. For the latter purpose, end 120*a* of plate 120 is of arcuate contour and is provided with gear teeth 126 which interengage with the teeth of a pinion 128 of a rotary position transducer 130 mounted on housing member 86 by means of a bracket 132. The teeth of pinion 128 have a sufficient vertical height to enable teeth 126 of plate member 120 to move vertically relative thereto in response to vertical displacements of roll 12 and thus piston rod 92. As is well known in connection with such a rotary position transducer, pivotal displacements of plate 120 in opposite directions about axis 46 imparts rotation in corresponding opposite directions to pinion 128 so as to provide an output signal from transducer 130 which is representative of the angular position of roll 12 relative to axis 46. End 120*b* of plate 120 underlies a vertically reciprocable plunger 134 of a linear position transducer 136 which is mounted on housing member 86 by means of a bracket 138. Plunger 134 is vertically reciprocated in opposite directions in response to corresponding vertical displacements of roll 12 and thus piston rod 92 and, as is well known in connection with such linear transducers, displacement of plunger 134 provides an output signal indicative of the position of roll 12 relative to a fixed horizontal reference such as roll housing 18.

Figure 6:
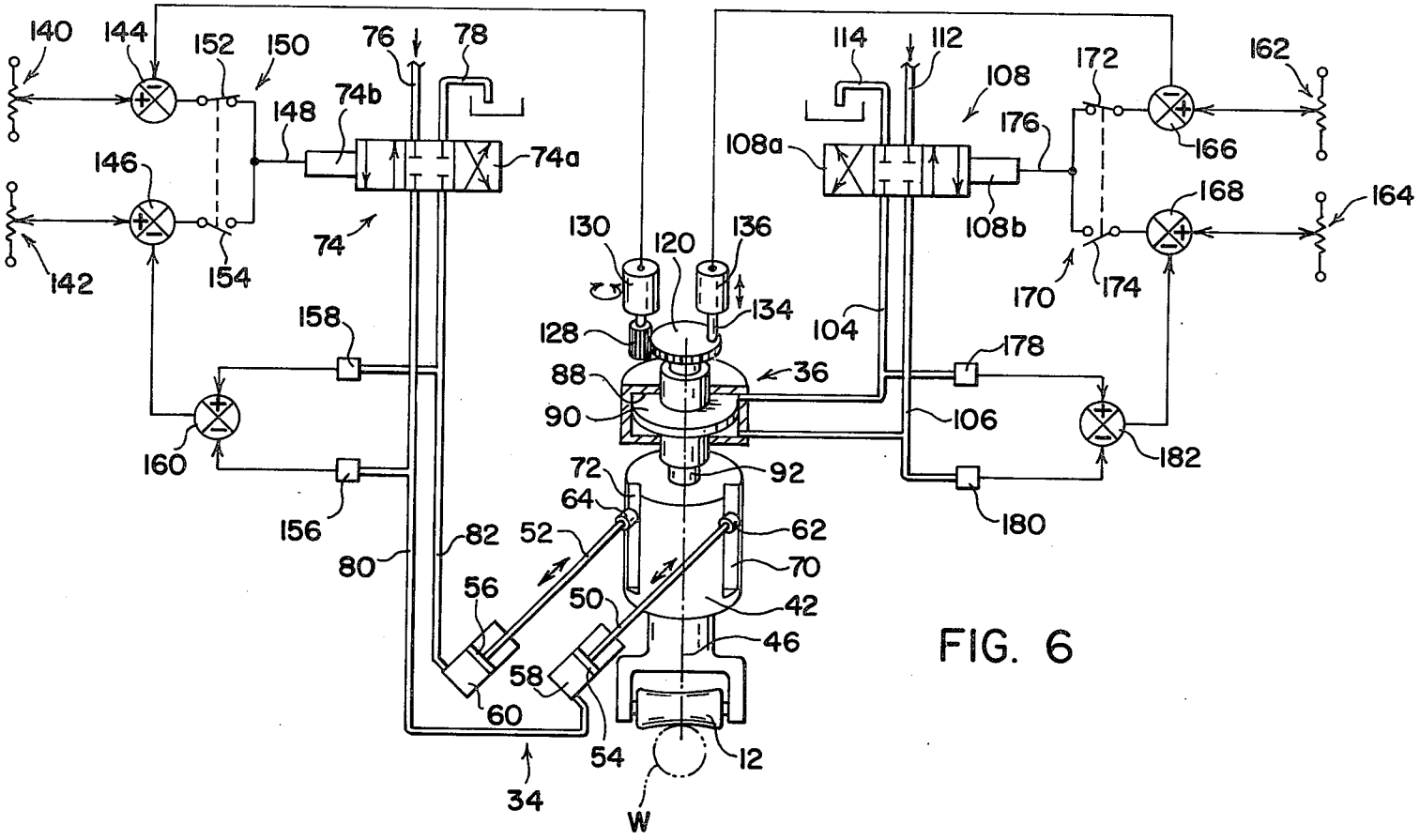
FIG. 6 is a schematic illustration of closed loop electro-hydraulic circuits by which angular and vertical roll orientation and adjustment can be achieved in accordance with the present invention; and, FIG. 7 is a schematic illustration of a modification of the circuitry in connection with the vertical position mode of control for the roll.

FIG. 6 schematically illustrates roll 12 and the angular and vertical orientation drive units therefor in corresponding servo valve controlled, closed loop electrohydraulic circuits by which angular or angular and vertical roll orientation can be achieved and maintained in accordance with the present invention. The component parts illustrated and described hereinabove in connection with FIGS. 3–5 are designated by corresponding numerals in FIG. 6. With regard first to obtaining and maintaining a desired angular orientation of roll 12 relative to axis 46, such angular orientation is adapted to be selectively controlled either in accordance with the angular position of roll 12 relative to vertical axis 46 or with respect to the angular contact force between the roll and workpiece W. Accordingly, the electro-hydraulic control circuit includes adjustable reference signal generators 140 and 142, such as potentiometers, which are settable by an operator to provide angular position and angular force reference signals, respectively, and which are respectively representative of a desired angular position of roll 12 relative to axis 46 and a desired angular contact force between roll 12 and workpiece W. The angular position reference signal is transmitted to a signal comparator 144 together with a signal from angular position transducer 130 and which latter signal is indicative of the actual angular position of roll 12 relative to axis 46. Similarly, the force reference signal is transmitted to a comparator 146 together with a signal indicative of actual angular force between roll 12 and workpiece W and which latter signal is generated as described more fully hereinafter. The reference and actual angular position signals transmitted to comparator 144 are combined therein to provide an output signal which is an angular position command signal, and the reference and actual force signals transmitted to comparator 146 are likewise combined therein to provide an output signal which is an angular force command signal. Depending on the mode of control selected by the operator, the position command or the force command signal is transmitted through line 148 to actuator portion 74*b* of servo valve unit 74 to control the position thereof.

To facilitate selectivity between the position and force modes of control, a double throw switch 150 is interposed between comparators 144 and 146 and line 148 and includes contacts 152 and 154 which, when in the position shown in FIG. 6, close the circuit between comparator 144 and line 148 and open the circuit between comparator 146 and line 148. Accordingly, with switch 150 in the position shown in FIG. 6 angular orientation of roll 12 is position controlled. Therefore, it will be appreciated that if the actual angular position signal from transducer 130 indicates the angular position of roll 12 to be other than that desired as represented by the reference signal from generator 140, a command signal to actuating portion 74*b* of servo valve unit 74 displaces the valve element to the appropriate position for correcting the angular position. For example, if the angular position signal from transducer 130 indicates that roll 12 should be pivoted counterclockwise relative to axis 46, the angular position command signal from comparator 144 will actuate the servo valve to the right from the null position shown in FIG. 6, whereby hydraulic fluid under pressure is delivered from the hydraulic fluid source through inlet passageway 76 to chamber 58 to displace roll support member 42 counterclockwise, such displacement being enabled by the flow of hydraulic fluid from chamber 60 through the servo valve and outlet passageway 78 back to the fluid source. When roll 12 is in the desired angular position, the servo valve returns to and remains in the null position. In the latter position, normal leakage across the valve as mentioned hereinabove provides for a small hydraulic pressure to be imposed against both pistons 54 and 56 to effectively hold roll support member 42 and thus roll 12 in the desired position.

In connection with the force mode of control, pressure transducers 156 and 158 are respectively connected to flow passageways 80 and 82 between the servo valve and actuator chambers 58 and 60. It will be appreciated that pressure transducers 156 and 158 are adapted to provide corresponding output signals indicative of the fluid pressure in chambers 58 and 60, respectively. The output signals from pressure transducers 156 and 158 are transmitted to a comparator 160 wherein the signals are combined to provide a differential output signal which is indicative of actual angular contact force between roll 12 and workpiece W. This actual force signal is transmitted to comparator 146 wherein it is combined with the angular force reference signal from generator 142 to produce an angular force command signal for transmission to actuating portion 74*b* of servo valve unit 74. It will be appreciated that by shifting switch 150 to the position closing contact 154 between comparator 146 and line 148, switch contact 152 opens and the angular force command signal is transmitted to the servo valve unit. It will be further appreciated that the angular force command signal controls the position of the servo valve element and thus angular displacement of roll support member 42 and roll 12 in the manner described hereinabove.

With regard to vertical orientation of roll 12, the latter orientation is likewise adapted to be selectively position or force controlled. For this purpose, vertical orientation drive unit 36 and servo valve unit 108 are connected in a closed loop electro-hydraulic control circuit separate from that for the angular orientation drive unit and solenoid unit 74. At the same time, the control circuits are the same with regard to the manner in which the mode of control is selected and with regard to the production of command signals for actuating the servo valve. In this respect, operator adjustable electric signal generators 162 and 164 are adapted to respectively provide reference signals indicative of a desired vertical roll position and a desired vertical contact force between roll 12 and workpiece W. The reference signal from generator 162 is transmitted to a signal comparator 166, and the reference signal from generator 164 is transmitted to a signal comparator 168. In the position mode of control, the reference signal from generator 162 and a signal from vertical position transducer 136 are combined in comparator 166 to produce a vertical position command signal. This command signal is transmitted to actuator portion 108*b* of servo valve unit 108 when contact 172 of double throw switch 170 is in the position shown in FIG. 6 closing the circuit between comparator 166 and line 176 leading to the servo valve. In connection with the force mode of control, pressure transducers 178 and 180 are respectively connected to passageways 104 and 106 between the servo valve and chamber 88 of drive unit 36 to produce output signals which are transmitted to a comparator 182 which provides a differential signal representative of actual vertical contact force between roll 12 and workpiece W. The signal from comparator 182 is transmitted to comparator 168 and is combined therein with the vertical force reference signal from generator 164 to provide an output signal which is a vertical force command signal. The latter signal is adapted to be transmitted to actuator portion 108*b* of servo valve unit 108 when switch 170 is manipulated from the position shown in FIG. 6 so that contact 174 closes the circuit between comparator 168 and line 176.

It is believed that the operation of the electrohydraulic control circuit to achieve vertical orientation of roll 12 either in the position or the force mode will be apparent from the foregoing description in connection with controlling angular orientation. Briefly in this respect, when the vertical orientation of roll 12 corresponds to a desired orientation as represented either by the vertical position reference signal or the vertical force reference signal, the servo valve is in its null position and the roll is effectively held in the desired vertical orientation by leakage across the servo valve which provides a small hydraulic pressure on opposite sides of piston 90. When in the position mode of control, vertical deviation of roll 12 from the desired position displaces plunger 134 of transducer 136 in the direction corresponding to such deviation, whereby the actual position output signal transmitted to comparator 166 changes as does the position command signal transmitted to actuator portion 108*b* of the servo valve. Accordingly, the servo valve is shifted from the null position to provide fluid flow to and from chamber 88 so as to displace piston 90 and thus roll 12 back toward the desired position. When in the force mode of control, a change in the vertical contact force between roll 12 and workpiece W results in a change in fluid pressure in chamber 88 and thus a change in the actual vertical contact force output signal from comparator 182. This changes the vertical force command signal transmitted to actuating portion 108*b* of the servo valve unit which responds accordingly to control fluid flow so as to achieve vertical displacement of roll 12 in the direction necessary to provide the desired vertical contact force thereof against the workpiece.

It will be appreciated from the foregoing description that once a reference signal indicative of a desired orientation crieteria is established, the closed loop control system thereafter operates automatically to maintain the predetermined desired roll orientation. It will be further appreciated that a desired change in orientation can quickly and easily be made while the machine is operating by adjusting the corresponding reference signal generator. While FIG. 6 illustrates two modes of control for both angular and vertical roll orientation, it will be appreciated that either one of the position or force modes of control could be employed independent of the other, the provision of both modes and the selectivity therebetween being most desirable with respect to optimizing the control capabilities in accordance with the present invention.

It will be appreciated from the foregoing description of the manner in which roll 12 is supported for angular displacement, and the description of the drive unit by which such displacement is achieved, that in connection with vertically fixed lower rolls 20 and 24, lower roll housing 26 would be provided with upwardly open chambers corresponding to chamber 44 and that the roll support members for these lower rolls and which correspond to member 42 would engage against the inner or bottom end of the chamber in a vertically fixed position relative to the lower roll housing. The vertical orientation drive unit 36 would be eliminated, although it will be appreciated that such units could be included if desired. With further regard to lower straightener rolls 20 and 24, it will be appreciated that rotary angular position transducer 130 can be structurally arranged relative to the lower roll housing and corresponding roll support member 42 so as to be driven thereby in connection with a position mode of control for angular orientation of these lower rolls. For example, in this respect, a shaft member attached to the roll support member and concentric with the vertical roll axis could extend through an opening in the bottom of lower roll support housing 26 and be provided with a toothed plate similar to plate 120, and the transducer unit could be mounted on the underside of the lower roll support housing in a position for pinion 128 to be driven by the toothed plate.

Figure 7:
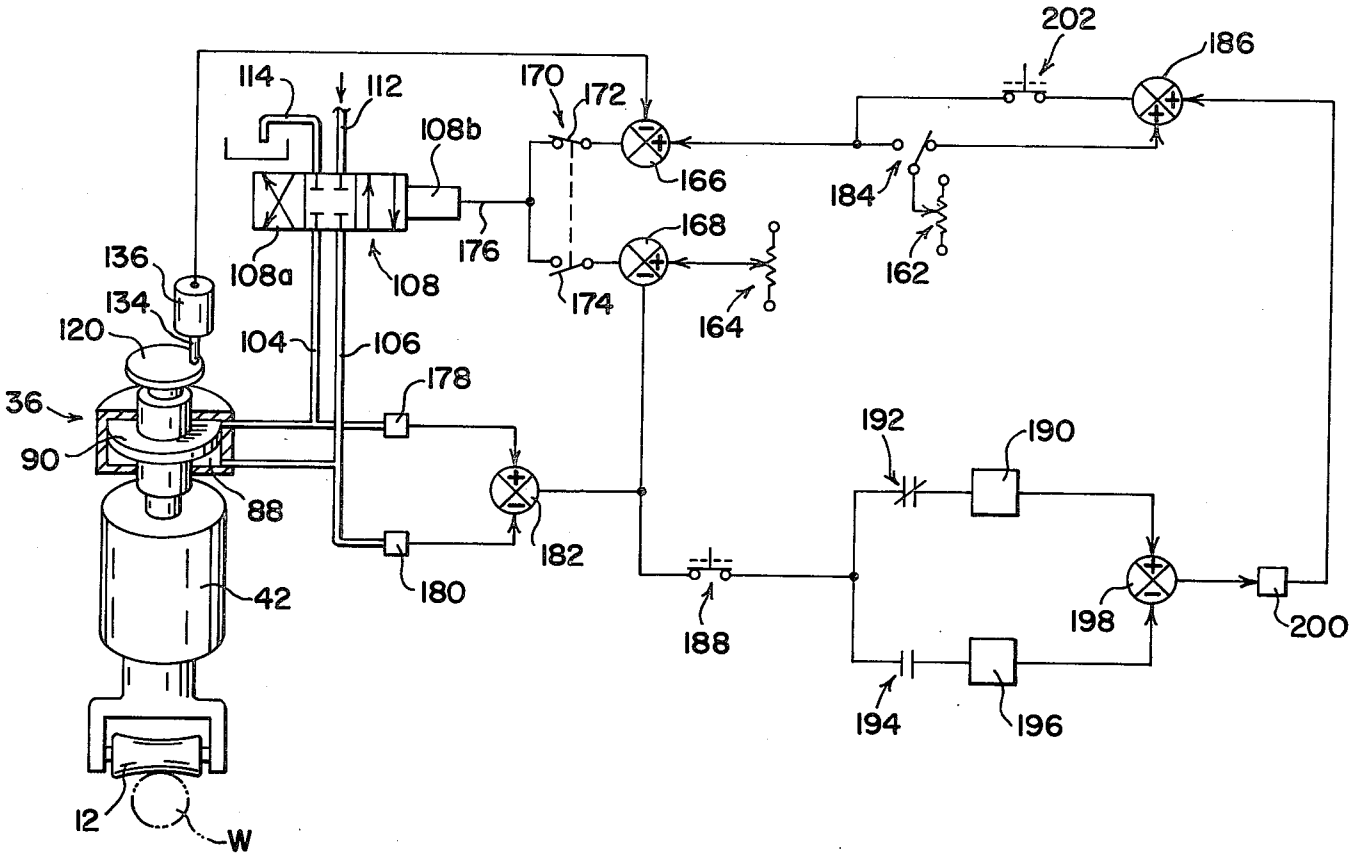

With regard to the vertical position mode of control for vertical orientation of the straightener rolls, it will be appreciated that the actual vertical roll position as detected by linear transducer 136 is the position of the roll relative to a fixed horizontal reference point such as the upper roll support housing 18. Therefore, the vertical positioning control system described above in connection with FIG. 6 does not provide compensation for roll gap variations occuring as a result of factors including the elasticity of posts 28 between the upper and lower roll support housings, straightener frame bending and shear deflection, and deflection of the roll supporting parts. These machine deflections are due to tube-to-roll force variations and normally are quite small as the result of the structural integrity of the straightener machine construction and have a negligible effect with regard to the quality of performance of the machine. Nevertheless, should it be desired under certain circumstances to provide a constant vertical roll gap, the control arrangement according to the present invention can readily be adapted to provide the same. A modification thereof for this purpose is schematically illustrated in FIG. 7. In this respect, with switch 170 positioned to achieve the vertical position mode of control, a switch 184 is adapted to be positioned as shown for the reference signal from position reference generator 162 to be transmitted to a comparator 186 rather than comparator 166. Further, during set-up of the machine a force differential signal from comparator 182 is adapted to be transmitted through a switch 188, when closed as shown, to a force memory register 190, such as in a digital computer, to provide a force reference signal indicative of desired vertical contact force to be maintained between the straightener roll and workpiece. During operation of the straightener machine, the latter reference force signal is locked into the memory by the opening of a normally closed switch 192, and a normally open switch 194 closes so the actual vertical force output signal from comparator 182 is transmitted to an actual force register 196. The outputs of registers 190 and 196 are transmitted to a comparator 198 to produce a differential force error signal which is multiplied in a multiplier 200 by a constant representative of the inverse of the straightener machine spring constant to produce a signal which is indicative of position error based on the desired constant vertical force. This position error signal is transmitted to comparator 186 together with the reference signal from position reference generator 162 to produce an output signal which is then transmitted to comparator 166 through a normally open switch 202 which is closed when the constant roll gap mode of operation is employed. The output signal from comparator 186 is combined in comparator 166 with the actual vertical position signal from linear transducer 136. The output of comparator 166 then provides the command signal for servo valve unit 108 to control vertical displacement of roll 12. It will be appreciated, therefore, that variations in roll gap separating force indicative of variations in the roll gap opening results in the differential vertical force signal from comparator 182 being continuously compared with the desired reference force signal in the memory of the computer, and the production in the computer of a position error signal which takes into account machine deflections and the like to enable position control in a manner which provides a constant roll gap.

While considerable emphasis has been placed herein on the structures and structural interrelationships between the component parts of preferred embodiments of straightener roll orientation control systems according to the present invention, it will be appreciated that many changes and modifications in the embodiments herein illustrated and described can be made without departing from the principles of the present invention and that such modifications and other embodiments will be suggested or obvious to those skilled in the art. Accordingly, it is to be distinctly understood that the foregoing descriptive matter is to be interpreted merely as illustrative of the present invention and not as a limitation.

Having thus described the invention, it is claimed:

1. A roll orientation control system for a straightener roll of a straightening machine including frame means and means supporting the roll for pivotal movement in opposite directions relative to such frame means about a vertical axis, said system comprising linearly displaceable fluid pressure actuated drive means for pivoting said roll in one and the other of said opposite directions, said drive means including first and second single acting hydraulic piston and cylinder means each having first member means fixed with respect to said frame means and second member means reciprocable relative to said first member means, said first member means being a pair of cylinders mounted on said frame means and each reciprocably supporting a piston and corresponding piston rod means, said piston rod means providing said second member means, each said piston rod means having an outer end interengaging said means supporting said roll in the same direction and at locations circumferentially spaced apart and on laterally opposite sides of said vertical axis, servo valve means responsive to an angular orientation command signal to control fluid flow relative to said first and second piston and cylinder means, means providing a first signal indicative of a desired angular orientation of said roll, means providing a second signal indicative of actual angular orientation of said roll, and means for combining said first and second signals to produce said angular orientation command signal.

2. A control system according to claim 1, wherein said means providing said first signal includes means for providing an angular force reference signal and an angular position reference signal, said means providing said second signal includes means for providing a force signal indicative of the actual angular force between said roll and a workpiece engaged thereby and means for producing a signal indicative of the actual angular position of said roll relative to said vertical axis, said means for combining said first and second signals including first means for combining said actual angular force signal and angular force reference signal to produce an angular force command signal and second means for combining said actual angular position signal and angular position reference signal to produce an angular position command signal, and means for selectively connecting said force command and said angular position command signals to said servo valve means.

3. A control system according to claim 2, wherein said means providing said actual angular force signal includes fluid pressure transducer means between said servo valve means and said drive means and responsive to displacement of said roll in opposite directions about said axis by said drive means, and wherein said means for producing said actual angular roll position signal includes transducer means displaceable in response to pivotal movement of said roll in said opposite directions.

4. A control system according to claim 1, wherein said means supporting said straightener roll further supports said roll for vertical reciprocation in opposite directions along said vertical axis and relative to said frame means, said system further including double acting fluid pressure actuated drive means for vertically reciprocating said roll, second servo valve means responsive to a vertical orientation command signal to control fluid flow relative to said double acting drive means, means providing a third signal indicative of a desired vertical orientation of said roll, means providing a fourth signal indicative of actual vertical orientation of said roll, and means for combining said third and fourth signals to produce said vertial orientation command signal.

5. A control system according to claim 4, wherein said means providing said third signal includes means for providing a vertical force reference signal and a vertical position reference signal, said means providing said fourth signal includes means for providing a signal indicative of the actual vertical force between said roll and a workpiece engaged thereby and means for providing a signal indicative of the actual vertical position of said roll relative to said frame means, said means for combining said third and fourth signals including first means for combining said vertical force reference signal and said actual vertical force signal to produce a vertical force command signal and second means for combining said vertical position reference signal and said actual vertical position signal to produce a vertical position command signal, and means for selectively connecting said vertical force command and said vertical position command signals to said second servo valve means.

6. A control system according to claim 5, wherein said means providing said first signal includes means for providing an angular force reference signal and an angular position reference signal, said means providing said second signal includes means for providing a force signal indicative of the actual angular force between said roll and a workpiece engaged thereby and means for producing a signal indicative of the actual angular position of said roll relative to said vertical axis, said means for combining said first and second signals including first means for combining said actual angular force signal and angular force reference signal to produce an angular force command signal and second means for combining said actual angular position signal and angular position reference signal to produce an angular position command signal, and means for selectively connecting said angular force command and said angular position command signals to said servo valve means.

7. A control system according to claim 6, wherein said means providing said actual angular force signal includes fluid pressure transducer means between said servo valve means and said drive means and responsive to displacement of said roll in opposite directions about said axis by said drive means, and wherein said means for producing said actual angular roll position signal includes transducer means displaceable in response to pivotal movement of said roll in opposite directions.

8. A control system according to claim 1, wherein said means supporting said roll includes a roll support member having planar surfaces facing said outer ends of said piston rod means, said outer ends vertically slidably engaging said surfaces, said roll support member being reciprocable along said vertical axis, a third cylinder on said frame means coaxial with said vertical axis, a third piston vertically reciprocable in said third cylinder, and means interconnecting said roll support member with said third piston for vertical displacement therewith.

9. A control system according to claim 8, wherein the last named means interconnects said third piston with said roll support member for pivotal movement therewith about said vertical axis.

10. A control system according to claim 9, and further including plate means interconnected with said third piston for reciprocation and pivotal movement therewith, rotary angular position transducer means supported adjacent said plate means for displacement in response to pivotal movement thereof, and linear vertical position transducer means supported adjacent said plate for displacement in response to vertical reciprocation thereof.

* * * * *